US008971743B2

(12) United States Patent
Miyazaki et al.

(10) Patent No.: US 8,971,743 B2
(45) Date of Patent: Mar. 3, 2015

(54) IMAGE FORMING APPARATUS AND IMAGE FORMING METHOD

(71) Applicants: Takafumi Miyazaki, Osaka (JP); Naoki Nakatake, Hyogo (JP); Yuji Nagatomo, Osaka (JP); Yasuhide Matsuno, Osaka (JP); Takahiro Sanada, Osaka (JP); Yasuhiro Fujiwara, Osaka (JP); Kyoko Abe, Osaka (JP); Takeshi Yamashita, Osaka (JP); Tomoya Adachi, Hyogo (JP)

(72) Inventors: Takafumi Miyazaki, Osaka (JP); Naoki Nakatake, Hyogo (JP); Yuji Nagatomo, Osaka (JP); Yasuhide Matsuno, Osaka (JP); Takahiro Sanada, Osaka (JP); Yasuhiro Fujiwara, Osaka (JP); Kyoko Abe, Osaka (JP); Takeshi Yamashita, Osaka (JP); Tomoya Adachi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/849,862

(22) Filed: Mar. 25, 2013

(65) Prior Publication Data

US 2013/0266332 A1 Oct. 10, 2013

(30) Foreign Application Priority Data

Apr. 5, 2012 (JP) ..... 2012-086554

(51) Int. Cl.
*G03G 15/05* (2006.01)
*G03G 15/16* (2006.01)
*G03G 15/047* (2006.01)

(52) U.S. Cl.
CPC ..... *G03G 15/16* (2013.01); *G03G 15/047* (2013.01)
USPC ..... 399/66; 399/128; 399/296

(58) Field of Classification Search
CPC ..... G03G 15/167; G03G 15/1675; G03G 15/5041; G03G 15/5054; G03G 15/047
USPC ..... 399/66, 128, 234, 235, 296, 297, 314
See application file for complete search history.

(56) References Cited

U.S. PATENT DOCUMENTS

| | | | | |
|---|---|---|---|---|
| 4,657,372 | A * | 4/1987 | Ikeda et al. | 399/13 |
| 5,006,904 | A * | 4/1991 | Matsuo et al. | 399/86 |
| 5,697,013 | A | 12/1997 | Sasaki | |
| 2004/0131385 | A1* | 7/2004 | Yoshikawa | 399/129 |
| 2006/0210326 | A1 | 9/2006 | Takehara et al. | |
| 2010/0008687 | A1* | 1/2010 | Ishii | 399/55 |
| 2010/0092188 | A1* | 4/2010 | Hirayama et al. | 399/27 |

FOREIGN PATENT DOCUMENTS

| | | |
|---|---|---|
| JP | 64-063990 | 3/1989 |
| JP | 8-234646 | 9/1996 |
| JP | 2009-008906 | 1/2009 |
| JP | 2009-031488 | 2/2009 |

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

An image forming apparatus including a latent image bearing member, a charger, a latent image forming device, a developing device, and a transfer device is provided. The transfer device is adapted to transfer a toner image formed on the latent image bearing member onto an intermediate transfer member or a recording medium by action of a transfer elected field in a transfer position where the latent image bearing member faces the transfer device. When a non-charged portion of the latent image bearing member that has not been charged to a predetermined potential by the charger passes through the transfer position, a strength of the transfer electric field is lowered than that in transferring the toner image.

13 Claims, 16 Drawing Sheets

IMAGE FORMING APPARATUS AND IMAGE FORMING METHOD

CROSS-REFERENCE TO RELATED APPLICATIONS

This patent application is based on and claims priority pursuant to 35 U.S.C. §119 to Japanese Patent Application No. 2012-086554, filed on Apr. 5, 2012, in the Japan Patent Office, the entire disclosure of which is hereby incorporated by reference herein.

BACKGROUND

1. Technical Field

The present disclosure relates to an image forming apparatus such as a copier, a printer, a facsimile machine, or a combined machine thereof. The present disclosure also related to an image forming method.

2. Description of Related Art

In an electrophotographic image forming apparatus, a surface of a photoreceptor, serving as a latent image bearing member, is charged by a charger and the charged surface is exposed to light emitted from an exposure device so that an electrostatic latent image is formed thereon. The electrostatic latent image is then supplied with toner, serving as a developer, from a developing device and developed into a toner image. The toner image on the photoreceptor is transferred onto a sheet of paper, serving as a recording medium, by a transfer device. Alternatively, the toner image on the photoreceptor is first transferred onto an intermediate transfer belt, serving as an intermediate transfer medium, and then transferred onto the sheet of paper from the intermediate transfer belt.

A typical transfer device has a transfer roller that serves as an electrode. The transfer roller is supplied with a voltage having the opposite polarity to the toner to form a transfer electric field between the transfer roller and the photoreceptor. When the toner image on the photoreceptor reaches a transfer position where the photoreceptor faces the transfer roller as the photoreceptor rotates, the toner image is transferred from the photoreceptor onto the sheet of paper or intermediate transfer belt by the electrostatic force generated in the transfer electric field.

At the same time, the surface of the photoreceptor passes through the transfer position while being effected by the charge of the transfer roller. As a result, the surface of the photoreceptor is charged to have the opposite polarity to the toner. Thus, the difference in potential between the developing device and the photoreceptor is lowered and the amount of toner supplied from the developing device to the photoreceptor is unnecessarily increased, causing a problem such that the back surface of the sheet of paper is contaminated with the toner. In attempting to solve this problem, JP-3457083-B2 (corresponding to JP-H08-234646-A) proposes a neutralizer that neutralizes the surface of the photoreceptor after the surface has passed through the transfer position.

However, installation of the neutralizer undesirably makes the apparatus much larger in size and cost.

SUMMARY

In accordance with some embodiments, an image forming apparatus is provided. The image forming apparatus includes a latent image bearing member, a charger, a latent image forming device, a developing device, and a transfer device. The latent image bearing member is adapted to bear a latent image on its surface. The charger is adapted to charge a surface of the latent image bearing member. The latent image forming device is adapted to form a latent image on the charged surface of the latent image bearing member. The developing device is adapted to supply a toner to the latent image to develop the latent image into a toner image. The transfer device is adapted to transfer the toner image formed on the latent image bearing member onto an intermediate transfer member or a recording medium by action of a transfer elected field in a transfer position where the latent image bearing member faces the transfer device. When a non-charged portion of the latent image bearing member that has not been charged to a predetermined potential by the charger passes through the transfer position, a strength of the transfer electric field is lowered than that in transferring the toner image.

In accordance with some embodiments, an image forming method is provided. The image forming method includes the steps of charging a surface of a latent image bearing member; forming a latent image on the charged surface of the latent image bearing member; supplying a toner to the latent image to develop the latent image into a toner image; transferring the toner image formed on the latent image bearing member onto an intermediate transfer member or a recording medium by action of a transfer elected field in a transfer position where the toner image is transferred from the latent image bearing member; and lowering a strength of the transfer electric field when a non-charged portion of the latent image bearing member that has not been charged to a predetermined potential passes through the transfer position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
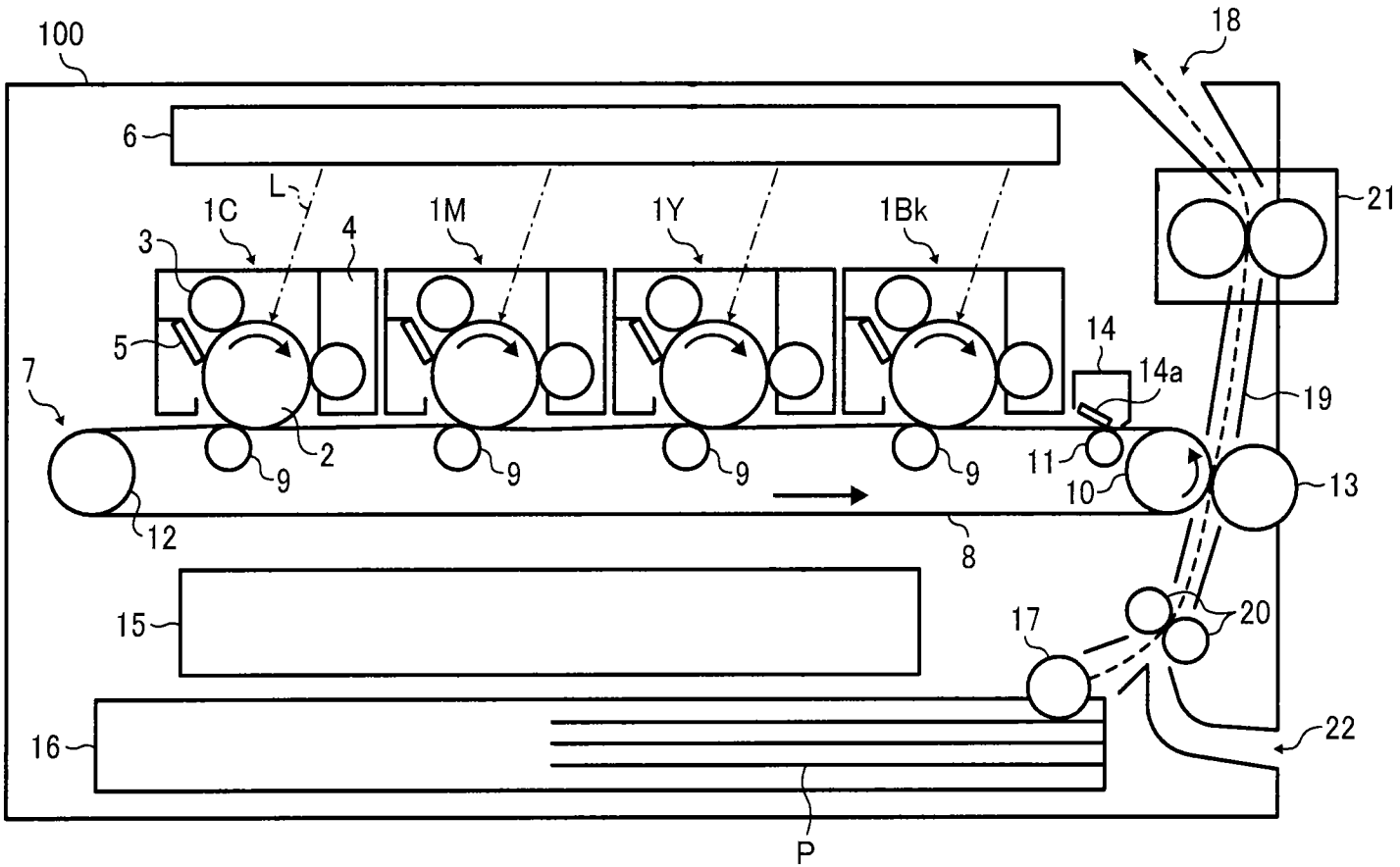
FIG. 1 is a schematic view of an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment. The apparatus illustrated in FIG. 1 is a full-color laser printer.

A main body 100 of the full-color laser printer is detachably mounted with four processing units 1Bk, 1Y, 1M, and 1C, serving as image forming units, at its center. The processing units 1Bk, 1Y, 1M, and 1C have the same configuration except for containing different-color toners of black, yellow, magenta, and cyan, respectively.

Each of the processing units 1Bk, 1Y, 1M, and 1C is equipped with a photoreceptor 2 serving as a latent image bearing member, a charging roller 3 to charge a surface of the photoreceptor 2, a developing device 4 to supply toner to a latent image on the photoreceptor 2 to form it into a toner image, and a cleaning blade 5 to clean the surface of the photoreceptor 2. In FIG. 1, for the sake of simplicity, the reference numerals for the photoreceptor 2, charging roller 3, developing device 4, and cleaning blade 5 are added to the processing unit 1C only.

In the present embodiment, the photoreceptor 2 is in the form of a cylindrical drum having a diameter of 30 mm and is driven to rotate at a peripheral speed of from 50 to 200 mm/s. The charging roller 3 is in contact with a surface of the photoreceptor 2 and is rotated as the photoreceptor 2 rotates. Upon application of a DC bias or that overlapped with AC to the charging roller 3 from a high-voltage power source, the surface of the photoreceptor 2 is uniformly charged. The developing device 4 is supplied with a predetermined developing bias from a high-voltage power source to supply toner to an electrostatic latent image formed on the photoreceptor 2 to develop it into a toner image that is visible. In the present embodiment, the developing device 4 is a one-component contact developing device. Specifically, the developing device 4 contains a one-component developer comprised of toner particles which are negatively chargeable. According to another embodiment, the developing device 4 may contain a two-component developer comprised of toner particles and carrier particles. The cleaning blade 5 is in contact with the photoreceptor 2 with its leading edge facing in the opposite direction of rotation of the photoreceptor 2 so as to remove foreign substances such as residual toner particles from the photoreceptor 2 as the photoreceptor 2 rotates.

An exposure device 6 to form latent images on the surfaces of the photoreceptors 2 is disposed above the processing units 1Bk, 1Y, 1M, and 1C. The exposure device 6 is comprised of light sources, polygon mirrors, f-θ lenses, and reflective mirrors and is adapted to direct laser light to the surfaces of the photoreceptors 2 based on image information. According to another embodiment, an LED head in which light-emitting diodes are arranged is used as the exposure device 6.

A transfer device 7 is disposed below the processing units 1Bk, 1Y, 1M, and 1C. The transfer device 7 has an intermediate transfer belt 8 serving as an intermediate transfer medium. The intermediate transfer belt 8 is stretched taut with four primary transfer rollers 9, a secondary transfer backup roller 10, a cleaning backup roller 11, and a tension roller 12. The intermediate transfer belt 8 rotates as the secondary transfer backup roller 10 is driven to rotate. The tension roller 12 is pressed against the intermediate transfer belt 8 by springs provided on the both ends thereof so as to stretch the intermediate transfer belt 8 taut.

According to some embodiments, the intermediate transfer belt 8 is in the form of an endless belt made of a film-like resin composition, such as vinylidene fluoride (PVDF), ethylene-ethylene tetrafluoride copolymer (ETFE), polyimide (PI), polycarbonate (PC), or thermoplastic elastomer (TPE), in which conductive materials such as carbon black are dispersed. In the present embodiment, the intermediate transfer belt 8 is a single-layer endless belt made of TPE having an elastic modulus in tension from 1,000 to 2,000 MPa in which carbon black is dispersed, having a thickness of 90 to 160 μm and a width of 230 mm. The electric volume resistivity is from $10^8$ to $10^{11}$ Ω·cm and the electric surface resistivity is from $10^8$ to $10^{11}$Ω/□ at 23° C., 50% RH, when measured by an instrument HIRESTA UP MCP-HT450 (available from Mitsubishi Chemical Analytech Co., Ltd.) at an applied voltage of 500 V and an applied time of 10 seconds.

Each primary transfer roller 9 is comprised of a sponge roller having a diameter of from 12 to 16 mm and is disposed facing each photoreceptor 2 with the intermediate transfer belt 8 therebetween. Each primary transfer roller 9 presses against a part of the inner peripheral surface of the intermediate transfer belt 8 to bring the corresponding part of the outer peripheral surface of the intermediate transfer belt 8 into contact with each photoreceptor 2. Thus, a primary transfer nip is formed between each part of the outer peripheral surface of the intermediate transfer belt 8 and each photoreceptor 2. Each primary transfer roller 9 is supplied with a predetermined primary transfer bias (e.g., from +100 to +2,000 V) from a high-voltage power source to form a primary transfer electric field in each primary transfer nip for transferring toner images. According to some embodiments, each primary transfer roller 9 may be comprised of an ionically conductive roller having a resistance of from $10^6$ to $10^8$Ω, which can be made of urethane in which carbon black is dispersed, NBR, or hydrin rubber; or an electronically conductive roller, which can be made of EPDM.

A secondary transfer roller 13 is disposed facing the secondary transfer backup roller 10 with the intermediate transfer belt 8 therebetween. The secondary transfer roller 13 is a sponge roller having a diameter of from 16 to 25 mm, which may be comprised of an ionically conductive roller having a resistance of from $10^6$ to $10^8$Ω, which can be made of urethane in which carbon black is dispersed, NBR, or hydrin rubber; or an electronically conductive roller, which can be made of EPDM. The secondary transfer roller 13 presses against a part of the outer peripheral surface of the intermediate transfer belt 8. Thus, a secondary transfer nip is formed between that part of the outer peripheral surface of the intermediate transfer belt 8 and the secondary transfer roller 13. The secondary transfer roller 13 is supplied with a predetermined secondary transfer bias from a high-voltage power source to form a secondary transfer electric field in the secondary transfer nip. In the present embodiment, the secondary transfer electric field is formed by what is called an attractive transfer method in which the secondary transfer roller 13 is supplied with a current of from +5 to +100 μA as the normal secondary transfer bias by means of constant current control while the secondary transfer backup roller 10 is grounded. Alternatively, in some embodiments, the secondary transfer electric field is formed by what is called a repulsive transfer method in which the secondary transfer backup roller 10 is supplied with a negative bias while the secondary transfer roller 13 is grounded.

When the resistance of the secondary transfer roller 13 exceeds the above-described range, the current is less flowable in the secondary transfer roller 13 and therefore the secondary transfer roller 13 needs to be supplied with a higher voltage in providing satisfactory transfer performance. However, provision of such a high-voltage power source may result in cost rise. In addition, application of high voltage may cause undesirable electric discharge in gaps near the transfer nips, which causes defective transfer of halftone images resulting in formation of white spots in the halftone images. Such a phenomenon significantly occurs in low-temperature and low-humidity conditions (e.g., 10° C., 15% RH). By contrast, when the resistance of the secondary transfer roller 13 falls below the above-described range, a multiple-color image portion (e.g., a portion where three different-color images are superimposed on one another) and a single-color image portion, if existing in the same image, may not be subject to successful transfer at the same time. This is because the single-color image portion is supplied with a sufficient amount of current and successfully transferable even when the applied voltage is relatively low, but the multiple-color image portion needs a higher voltage to be successfully transferable. If the voltage is set such that the multiple-color image portion is successfully transferable, the single-color image portion may be supplied with an excessive amount of current and the degree of transfer efficiency is lowered. The resistances of the primary transfer rollers 9 and secondary transfer roller 13 are determined from current values measured as follows. First, put each roller on a conductive metallic plate and apply a load of 4.9 N to each end of the core metal of the roller. Apply a voltage of 1 kV to between the core metal and the metallic plate and measure a current value.

According to an embodiment, the secondary transfer backup roller 10 is comprised of a polyurethane rubber having a thickness of from 0.3 to 1 mm or a thin-layer coating roller having a thickness of from 0.03 to 0.1 mm. In the present embodiment, the secondary transfer backup roller 10 is comprised of an urethane coating roller having a thickness of 0.05 mm and a diameter of 19 mm. The diameter of the roller does not change very much by temperature change. The electric resistance of the secondary transfer backup roller 10 is $10^6\Omega$ or less, which is lower than that of the secondary transfer roller 13.

Referring to FIG. 1, a belt cleaner 14 to clean the surface of the intermediate transfer belt 8 is disposed facing the intermediate transfer belt 8. The belt cleaner 14 includes a cleaning blade 14*a*. A leading edge of the cleaning blade 14*a* is in contact with a surface of the intermediate transfer belt 8 and supported by the cleaning backup roller 11. As the intermediate transfer belt 8 rotates, the cleaning blade 14*a* scrapes off residual toner particles and foreign substances from the surface of the intermediate transfer belt 8. The belt cleaner 14 has a simple configuration owing to the employment of the cleaning blade 14*a*. When toner particles including an oil-containing silica as an external additive are in use, a part of the oil-containing silica is formed into a highly lubricative layer at the leading edge of the cleaning blade 14*a*. As a result, cleaning ability of the cleaning blade 14*a* is increased and the lifespan of the intermediate transfer belt 8 is extended. Referring to FIG. 1, a waste toner storage 15 to store toner particles removed by the belt cleaner 14 is disposed below the transfer device 7.

According to some embodiments, the belt cleaner 14 may employ an electrostatic brush or an electrostatic roller in place of the cleaning blade 14*a*.

Below the main body 100, a paper feed tray 16 storing a recording medium P and a paper feed roller 17 to feed the recording medium P from the paper feed tray 16 are disposed. The recording medium P may include, for example, sheets of thick paper, normal paper, thin paper, coated paper, art paper, or tracing paper; postcards; or envelopes. Alternatively, transparent sheets or films for use in overhead projector can also be usable as the recording medium P.

Within the main body 100, a feed path 19 to feed the recording medium P from the paper feed tray 16 to an ejection outlet 18 via the secondary transfer nip is disposed. On the feed path 19, a pair of registration rollers 20 is disposed upstream from the secondary transfer roller 13 relative to the direction of feed of the recording medium P. A fixing device 21 to fix unfixed toner images on the recording medium P is disposed downstream from the secondary transfer roller 13 relative to the direction of feed of the recording medium P. The main body 100 has a manual feed inlet 22 to manually feed the recording medium P to the feed path 19.

In the present embodiment, the imaging speed is variable according to the kind of the recording medium P. For example, when the recording medium P is a paper having a basis weight of 100 g/m$^2$ or more, the imaging speed is reduced to one-half so that the recording medium P can spend twice the normal imaging time passing the fixing device 21. Thus, toner images can be reliably fixed on the recording medium P.

At the beginning of an imaging operation, each photoreceptor 2 in each processing unit 1Bk, 1Y, 1M, and 1C is driven to rotate clockwise in FIG. 1 by a driving device. A surface of each photoreceptor 2 is then uniformly charged by each charging roller 3 to have a predetermined polarity. The charged surfaces of the photoreceptors 2 are exposed to laser light emitted from the exposure device 6 based on image information of a document read by a reading device. Thus, an electrostatic latent image is formed on each photoreceptor 2. In particular, the photoreceptors 2 are exposed to laser light based on the respective single color image information of black, yellow, magenta, and cyan separated from full-color image information. Each electrostatic latent image formed on each photoreceptor 2 is supplied with toner from each developing device 4 and developed into a toner image that is visible.

On the other hand, the secondary transfer backup roller 10 is driven to rotate counterclockwise in FIG. 1 so that the intermediate transfer belt 8 is driven to rotate in the direction indicated by an arrow in FIG. 1. Each primary transfer roller 9 is supplied with a primary transfer bias having the opposite polarity to the toner so that a transfer electric field is formed in each primary transfer nip.

When the toner images on the respective photoreceptors 2 reach the respective primary transfer nip as the photoreceptors 2 rotate, the toner images are sequentially transferred from the respective photoreceptors 2 onto the intermediate transfer belt 8 and superimposed on one another by action of the transfer electric fields formed in the primary transfer nips. Thus, a full-color toner image is formed on a surface of the intermediate transfer belt 8. Residual toner particles remaining on each photoreceptor 2 without being transferred onto the intermediate transfer belt 8 are removed by each cleaning blade 5.

At the lower part of the main body 100, the paper feed roller 17 starts rotating to feed the recording medium P from the paper feed tray 16 to the feed path 19. The pair of registration rollers 20 timely feeds the recording medium P to the secondary transfer nip through the feed path 19. The secondary transfer roller 13 is supplied with a transfer voltage having the opposite polarity to the toner image on the intermediate transfer belt 8 so that a transfer electric field is formed in the secondary transfer nip.

When the toner image on the intermediate transfer belt 8 reaches the secondary transfer nip as the intermediate transfer belt 8 rotates, the toner image is transferred from the intermediate transfer belt 8 onto the recording medium P by action of the transfer electric field formed in the secondary transfer nip. Residual toner particles remaining on the intermediate transfer belt 8 without being transferred onto the recording medium P are removed by the belt cleaner 14 and collected in the waste toner storage 15.

The recording medium P having the toner image thereon is separated from the intermediate transfer belt 8 owing to the curvature of the secondary transfer backup roller 10 and then fed to the fixing device 21. In the fixing device 21, the toner image is fixed on the recording medium P. The recording medium P having the fixed toner image is ejected from the ejection outlet 18.

In the above-described embodiment, all the four processing units 1Bk, 1Y, 1M, and 1C are brought into operation to form full-color images. According to another embodiment, only one of the four processing units 1Bk, 1Y, 1M, and 1C is brought into operation to form single-color images. According to another embodiment, two or three of the four processing units 1Bk, 1Y, 1M, and 1C are brought into operation to form two-color or three-color toner images.

In accordance with some embodiments, usable toner can be prepared as follows.

Preparation of Polyester

Charge a reaction vessel equipped with a condenser, a stirrer, and a nitrogen inlet pipe with 235 parts of ethylene oxide 2 mol adduct of bisphenol A, 525 parts of propylene oxide 3 mol adduct of bisphenol A, 205 parts of terephthalic acid, 47 parts of adipic acid, and 2 parts of dibutyltin oxide. Subject the mixture to a reaction at 230° C. for 8 hours under normal pressures and subsequent 5 hours under reduced pressures of from 10 to 15 mmHg. After adding 46 parts of trimellitic anhydride, further subject the mixture to a reaction at 180° C. for 2 hours under normal pressures. Thus, a polyester is prepared. The polyester has a number average molecular weight of 2,600, a weight average molecular weight of 6,900, a glass transition temperature (Tg) of 44° C., and an acid value of 26.

Preparation of Prepolymer

Charge a reaction vessel equipped with a condenser, a stirrer, and a nitrogen inlet pipe with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. Subject the mixture to a reaction at 230° C. for 8 hours under normal pressures and subsequent 5 hours under reduced pressures of from 10 to 15 mmHg. Thus, an intermediate polyester is prepared. The intermediate polyester has a number average molecular weight of 2,100, a weight average molecular weight of 9,500, a glass transition temperature (Tg) of 55° C., an acid value of 0.5, and a hydroxyl value of 49.

Charge a reaction vessel equipped with a condenser, a stirrer, and a nitrogen inlet pipe with 411 parts of the intermediate polyester, 89 parts of isophorone diisocyanate, and 500 parts of ethyl acetate. Subject the mixture to a reaction at 100° C. for 5 hours. Thus, a prepolymer is prepared. The prepolymer is including 1.53% of free isocyanates.

Preparation of Master Batch

Mix 40 parts of a carbon black (REGAL 400R from Cabot Corporation), 60 parts of a polyester resin (RS-801 from Sanyo Chemical Industries, Ltd., having an acid value of 10, a weight average molecular weight of 20,000, and a glass transition temperature of 64° C.), and 30 parts of water, by a HENSCHEL MIXER. The resulting mixture is a carbon black aggregate into which water seep. Knead the mixture for 45 minutes by a double roll while setting the roll surface temperature to 130° C. Pulverize the kneaded mixture so that the pulverized products each have a size of about 1 mm. Thus, a master batch is prepared.

Preparation of Colorant Wax Dispersion

Charge a reaction vessel equipped with a stirrer and a thermometer with 545 parts of the polyester prepared above, 181 parts of a paraffin wax, and 1,450 parts of ethyl acetate. Heat the mixture to 80° C. while agitating it, keep it at 80° C. for 5 hours, and cool it to 30° C. over a period of 1 hour. Further add 500 parts of the master batch, 100 parts of a charge controlling agent, and 100 parts of ethyl acetate to the vessel and agitate the mixture for 1 hour.

Thereafter, subject 1,500 parts of the resulting mixture to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. Repeat this dispersing operation 3 times (3 passes). Further add 425 parts of the polyester and 230 parts of ethyl acetate and subject the resulting mixture to the above dispersing operation once (1 pass). Thus, a colorant wax dispersion is prepared. Add an amount of ethyl acetate to the colorant wax dispersion so that the solid content gets 50% by weight.

Preparation of Water Phase

Mix 970 parts of ion-exchange water, 40 parts of a 25% aqueous dispersion of an organic resin particle (i.e., fine particles of a copolymer of styrene, methacrylic acid, butyl acrylate, and a sodium salt of a sulfate of ethylene oxide adduct of methacrylic acid), 140 parts of a 48.5% aqueous solution of dodecyl diphenyl ether sodium disulfonate (ELEMINOL MON-7 from Sanyo Chemical Industries, Ltd.), and 90 parts of ethyl acetate. Thus, an aqueous phase that is a milky whitish liquid is prepared.

Emulsification

Mix 975 parts of the colorant wax dispersion and 2.6 parts of isophorone diamine by a TK HOMOMIXER (from PRIMIX Corporation) at a revolution of 5,000 rpm for 1 minute. After further adding 88 parts of the prepolymer, agitate the mixture by a TK HOMOMIXER at a revolution of 5,000 rpm for 1 minute. After further adding 1,200 parts of the aqueous phase, agitate the mixture by a TK HOMOMIXER at a revolution of from 8,000 to 13,000 rpm for 20 minutes. Thus, an emulsion slurry is prepared.

Solvent Removal

Charge a vessel equipped with a stirrer and a thermometer with the emulsion slurry and subject it to a solvent removal treatment at 30° C. for 8 hours. Thus, a dispersion slurry is prepared.

Washing and Drying (0) Filter 100 parts of the dispersion slurry under reduced pressures.

(1) Mix the filtration cake obtained in (0) with 100 parts of ion-exchange water by a TK HOMOMIXER at a revolution of 12,000 rpm for 10 minutes and then subject the mixture to a filtration. The resulting filtrate is milky white.

(2) Mix the filtration cake obtained in (1) with 900 parts of ion-exchange water by a TK HOMOMIXER at a revolution of 12,000 rpm for 30 minutes while giving ultrasonic vibration thereto and then subject the mixture to a filtration under reduced pressures. Repeat this operation until the electric conductivity of the reslurry liquid equals or falls below 10 μC/cm.

(3) Add an amount of 10% of hydrochloric acid to the reslurry liquid so that its pH gets 4. Agitate the mixture by a THREE-ONE MOTOR for 30 minutes and then subject it to a filtration.

(4) Mix the filtration cake obtained in (3) with 100 parts of ion-exchange water by a TK HOMOMIXER at a revolution of 12,000 rpm for 10 minutes and then subject the mixture to a filtration. Repeat this operation until the electric conductivity of the reslurry liquid equals or falls below 10 μC/cm. Thus, a filtration cake is obtained.

Dry the filtration cake by a circulating drier at 42° C. for 48 hours and sieve it with a mesh having an opening of 75 μm. Thus, a mother toner is prepared. The mother toner has an average circularity of 0.974, a volume average particle diameter (Dv) of 6.3 μm, a number average particle diameter (Dp) of 5.3 μm, and a particle size distribution (Dv/Dp) of 1.19.

Mix the above-obtained mother toner with 1 part of fine silica particles without oil treatment having an average primary particle diameter of 12 nm (H20™ from Clariant Japan K.K.) and 2 parts of fine silica particles with oil treatment having an average primary particle diameter of 40 nm (RY50 from Nippon Aerosil Co., Ltd.). Sieve the mixture with a mesh having an opening of 60 μm to remove coarse particles and aggregates. Thus, a toner is prepared.

Figure 2:
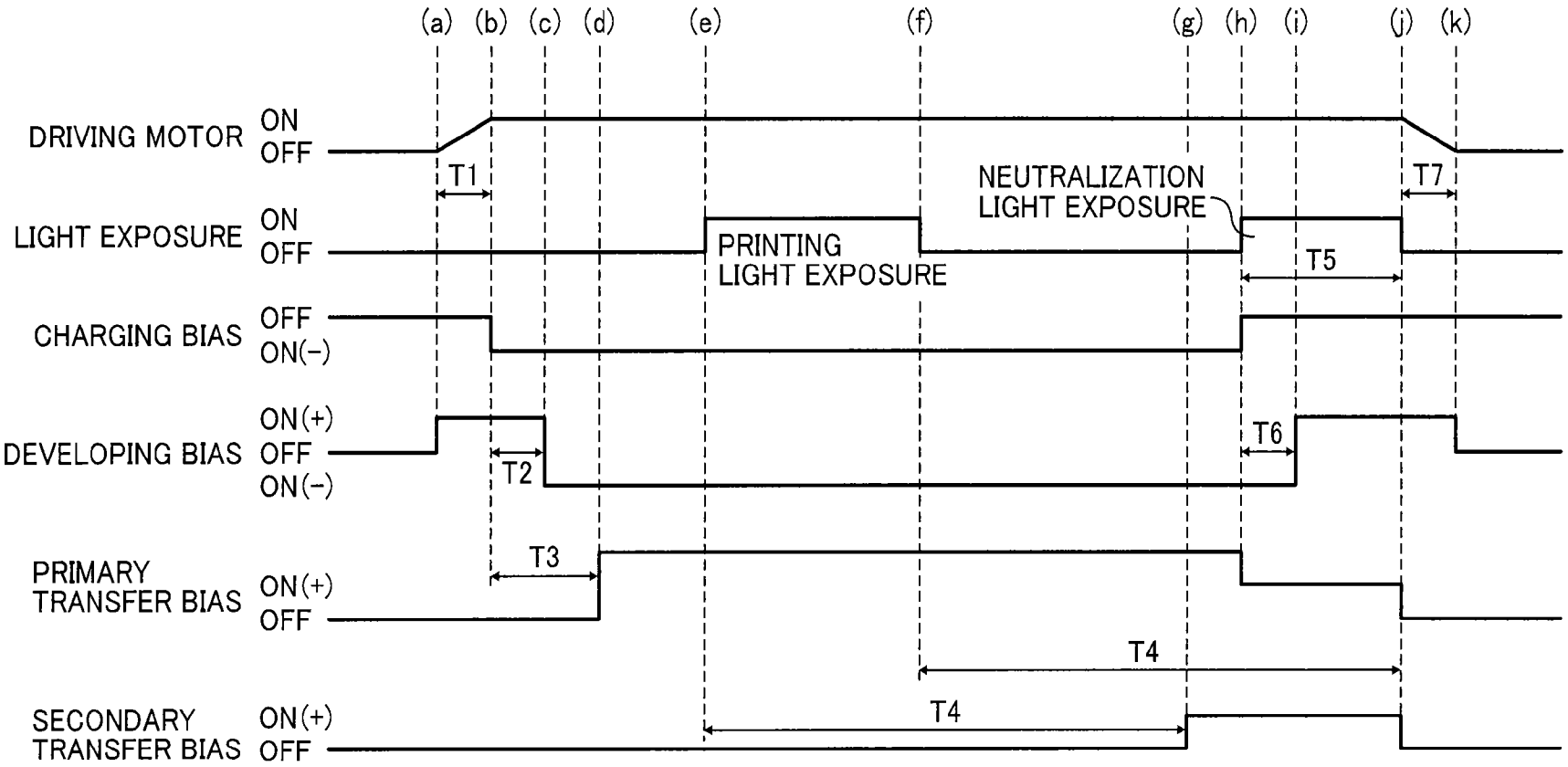
FIG. 2 is a timing chart showing operational sequences in forming a single-color (e.g., black) image by the above image forming apparatus according to an embodiment.

FIG. 2 is a timing chart showing operational sequences in forming a single-color (e.g., black) image by the above-described image forming apparatus according to an embodiment. FIGS. 3A to 3K are situational views of the image forming apparatus at timings (a) to (k) shown in FIG. 2, respectively.

Figure 3A:
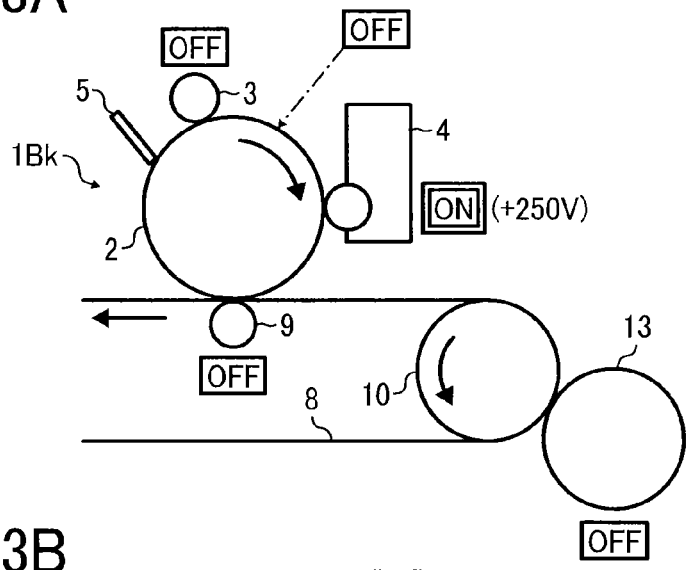
FIGS. 3A to 3K are situational views of the above image forming apparatus at timings (a) to (k) shown in FIG. 2, respectively.

At a timing (a) shown in FIG. 2, a common driving motor starts driving to rotate both the photoreceptor 2 and the intermediate transfer belt 8, as illustrated in FIG. 3A. Simultaneously, the developing device 4 starts being supplied with a positive developing bias (e.g., +250 V). The reason that the developing device 4 is supplied with a positive developing bias is to prevent toner particles stored in the developing device 4 from unnecessarily transferring to the photoreceptor 2. In particular, because of being negatively charged, the toner particles stored in the developing device 4 are likely kept adsorbed to the developing device 4 without transferring to the photoreceptor 2 when the developing device 4 is positively charged.

At the timing (a), the photoreceptor 2 is not exposed to light emitted from the exposure device 6, the charging roller 3 is not supplied with a charging bias, the primary transfer roller 9 is not supplied with a primary transfer bias, and the secondary transfer roller 13 is not supplied with a secondary transfer bias.

Figure 3B:
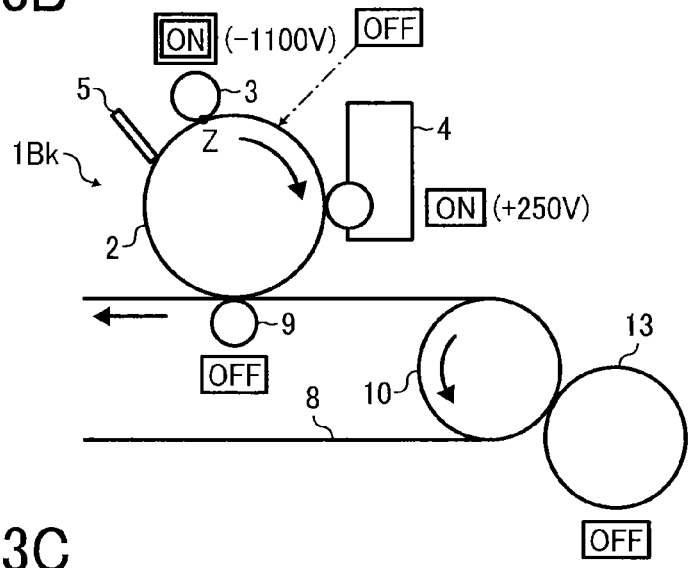

At a timing (b) shown in FIG. 2, the charging roller 3 starts being supplied with a negative charging bias (e.g., −1,100 V). As a result, a surface of the photoreceptor 2 is charged to a negative potential (e.g., −500 V). The timing (b) for supplying the charging bias comes after the elapse of a period of time T1 from the timing (a) for starting the drive of the driving motor. The period of time T1 is required for the driving motor to stabilize its driving performance. Referring to FIG. 3B, a symbol Z represents a portion where the charging of the photoreceptor 2 is started, i.e., the leading edge of the charged portion of the photoreceptor 2.

Figure 3C:
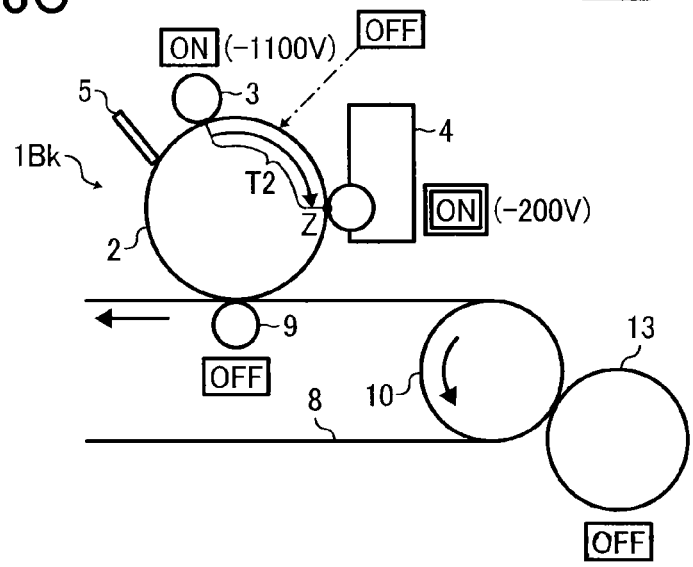

At a timing (c) shown in FIG. 2, the developing bias is switched from positive to negative (e.g., −200 V). The timing (c) for switching the polarity of the developing bias comes after the elapse of a period of time T2 from the timing (b). The period of time T2 is required for a surface of the photoreceptor 2 to travel from a charging position where the photoreceptor 2 faces the charging roller 3 to a developing position where the photoreceptor 2 faces the developing device 4. In particular, when the leading edge Z of the charged portion of the photoreceptor 2 reaches the developing position where the photoreceptor 2 faces the developing device 4, as illustrated in FIG. 3C, the developing bias is switched from positive to negative. The reason that the developing bias is switched from positive to negative is to allow toner particles to transfer from the developing device 4 onto an electrostatic latent image formed on the photoreceptor 2 in a developing process (to be described later).

Figure 3D:
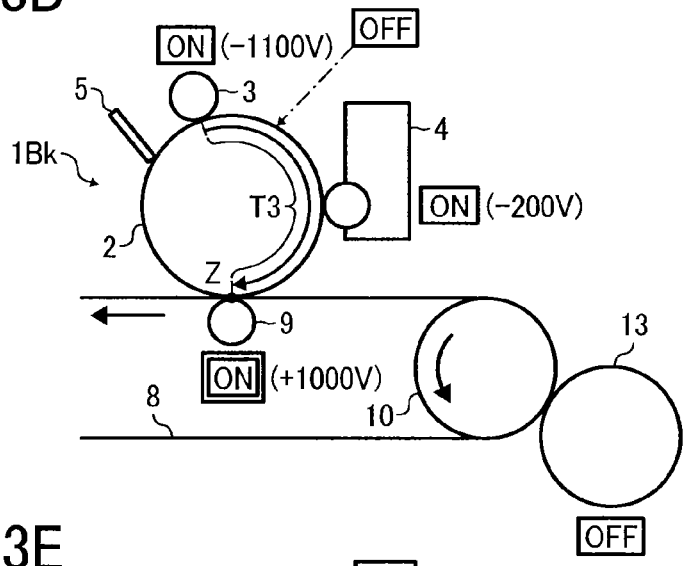

At a timing (d) shown in FIG. 2, the primary transfer roller 9 starts being supplied with a positive primary transfer bias (e.g., +1,000 V). The timing (d) for supplying the primary transfer bias comes after the elapse of a period of time T3 from the timing (b). The period of time T3 is required for a surface of the photoreceptor 2 to travel from the charging position where the photoreceptor 2 faces the charging roller 3 to a primary transfer position where the photoreceptor 2 faces the primary transfer roller 9. In particular, when the leading edge Z of the charged portion of the photoreceptor 2 reaches the primary transfer position, as illustrated in FIG. 3D, the primary transfer roller 9 starts being supplied with a positive primary transfer bias. Thus, a primary transfer electric field is formed between the primary transfer roller 9 and the photoreceptor 2 within which toner images are transferable.

Figure 3E:
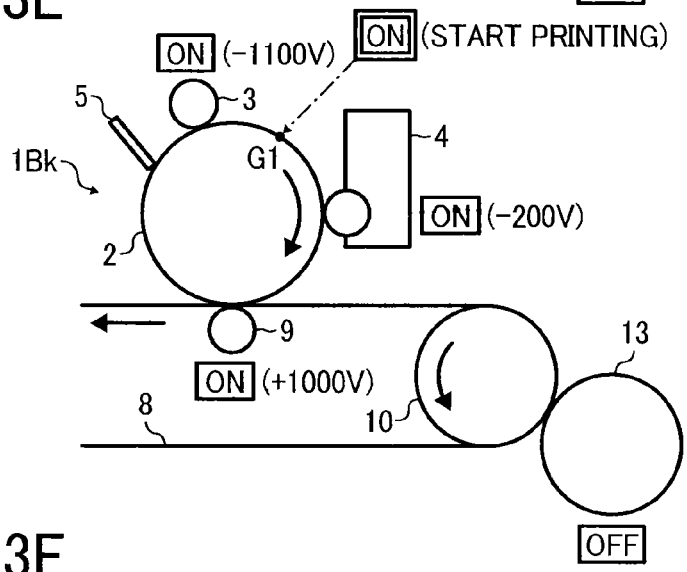

At a timing (e) shown in FIG. 2, the charged portion of the photoreceptor 2 starts being exposed to light based on image information (hereinafter may be called as "printing light"). As a result, an electrostatic latent image is formed on the photoreceptor 2. The latent image has a predetermined surface potential (e.g., −50 V), which is lower than the surface potential (e.g., −500 V) of the photoreceptor 2 caused by uniform charging by the charging roller 3. Referring to FIG. 3E, a symbol G1 represents a portion on the photoreceptor 2 where the exposure to printing light is started, i.e., the leading edge of the latent image.

Figure 3F:
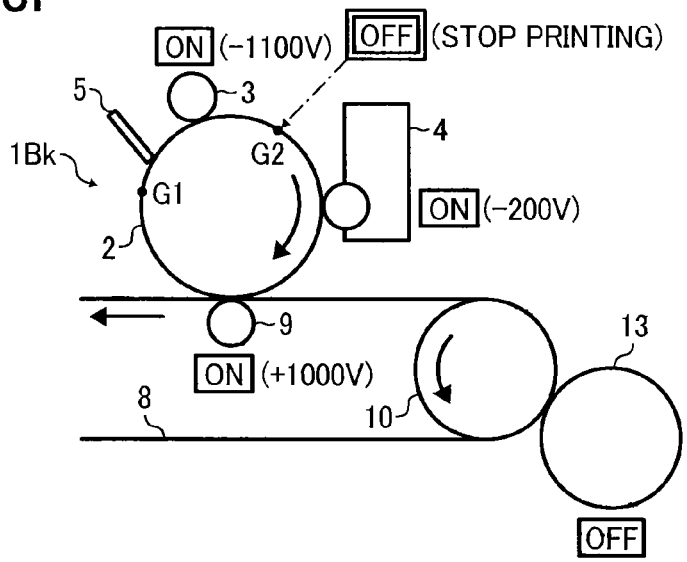

At a timing (f) shown in FIG. 2, exposure of the photoreceptor 2 to printing light is terminated. Referring to FIG. 3F, a symbol G2 represents a portion on the photoreceptor 2 where the exposure to printing light is terminated, i.e., the trailing edge of the latent image.

At the developing position, toner particles stored in the developing device 4 are transferred onto the latent image having been formed on the photoreceptor 2. (This process is hereinafter referred to as "developing process".) Thus, a toner image is formed. More specifically, toner particles stored in the developing device 4 that are negatively charged are allowed to adsorb to the latent image on the photoreceptor 2 because the potential of the latent image on the photoreceptor 2 (e.g., −50V) is more positive than that of the developing device 4 (e.g., −200 V). On the other hand, the toner particles that are negatively charged are not allowed to transfer onto non-image portions on the photoreceptor 2 because the potential of the non-image portions (e.g., −500 V) is more negative than that of the developing device 4 (e.g., −200 V).

At the primary transfer position, the toner image formed on the photoreceptor 2 is transferred onto the intermediate transfer belt 8. (This process is hereinafter referred to as "primary transfer process".) More specifically, the toner particles are allowed to transfer from the photoreceptor 2 onto the intermediate transfer belt 8 because the potential of the primary transfer roller 9 (e.g., +1,000 V) supplied with the primary transfer bias is more positive than that of the photoreceptor 2.

Figure 3G:
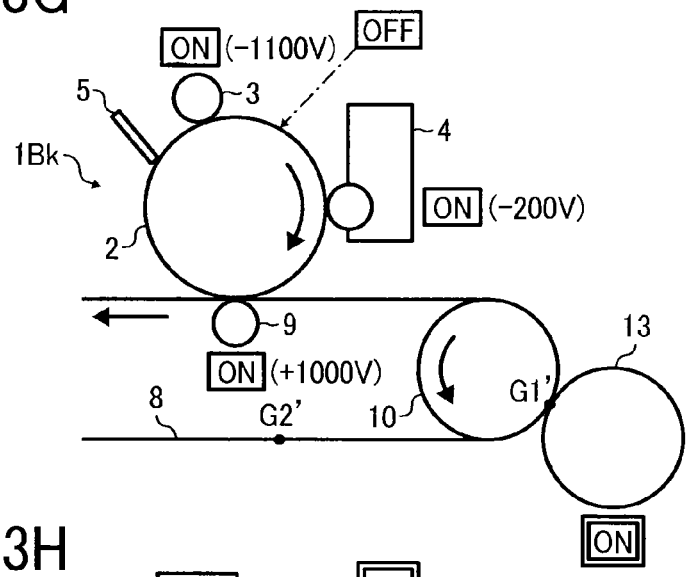

At a timing (g) that comes after the elapse of a period of time T4 from the timing (e) for starting the exposure to printing light, the secondary transfer roller 13 starts being supplied with a secondary transfer bias. The period of time T4 is a sum of a time period required for a surface of the photoreceptor 2 to travel from the charging position to the primary transfer position and another time period required for a surface of the intermediate transfer belt 8 to travel from the primary transfer position to a secondary transfer position where the intermediate transfer belt 8 faces the secondary transfer roller 13. In particular, when a leading edge G1' of the toner image having been transferred onto the intermediate transfer belt 8 reaches the secondary transfer position, as illustrated in FIG. 3G the secondary transfer roller 13 starts being supplied with a secondary transfer bias. As a result, the toner image is transferred onto a recording medium.

Figure 3H:
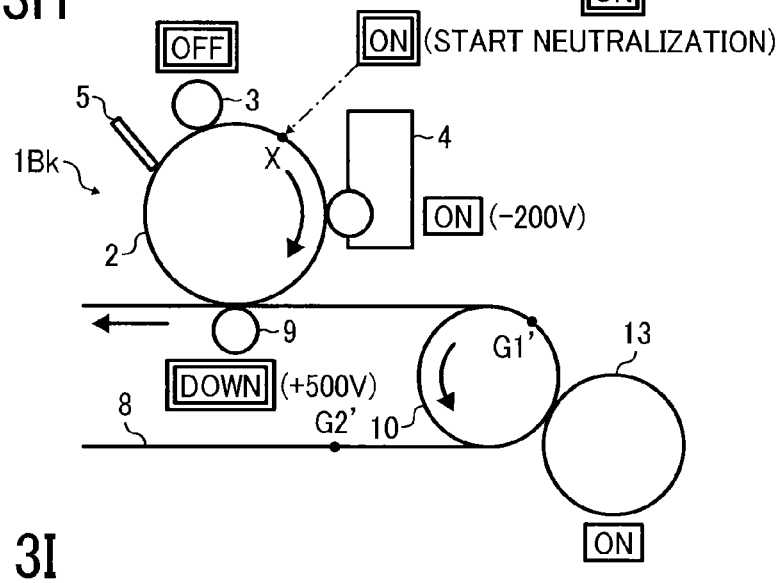

At a timing (h) shown in FIG. 2, the photoreceptor 2 starts being exposed to neutralization light. In particular, the entire charged portion of the photoreceptor 2 is exposed to neutralization light emitted from the exposure device 6 so that its surface potential is lowered to a predetermined potential (e.g., from −500 V to −50 V). (This process is hereinafter referred to as "neutralization process".) As a result, a non-charged portion that has not been charged by the charging roller 3 to a predetermined potential is formed on the photoreceptor 2. Referring to FIG. 3H, a symbol X represents a portion on the photoreceptor 2 where the exposure to neutralization light is started, i.e., the leading edge of the non-charged portion. At the timing (h), the application of the charging bias is terminated. Simultaneously, the output of the primary transfer bias is lowered (e.g., from +1,000 V to +500 V) so that the strength of the transfer electric field is lowered than that in transferring images.

In the neutralization process, the photoreceptor 2 only has to be reduced its absolute surface potential and is not necessarily completely neutralized. In other words, the surface potential of the photoreceptor 2 only has to be brought close to zero and is not necessarily reduced to zero. Alternatively, the neutralization process itself is not necessary only if said non-charged portion that has not been charged by the charging roller 3 to a predetermined potential is formed otherwise.

Figure 3I:
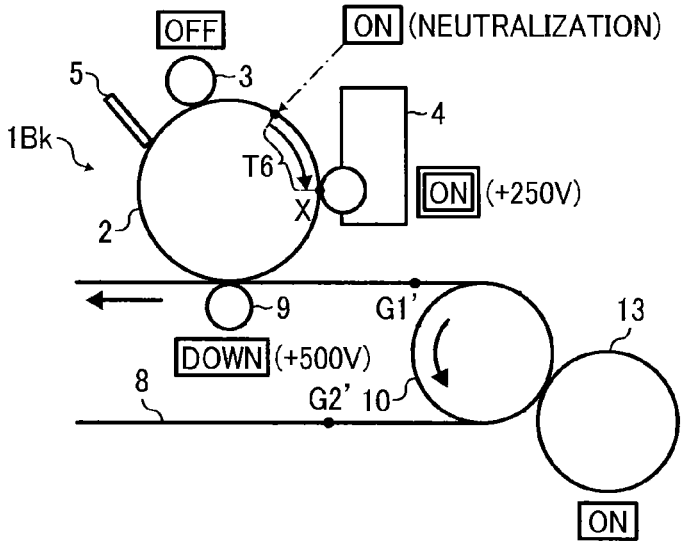

At a timing (i) shown in FIG. 2, the developing bias is switched from negative to positive. The timing (i) for switching the polarity of the developing bias comes after the elapse of a period of time T6 from the timing (h). The period of time T6 is required for a surface of the photoreceptor 2 to travel from an exposure position where the photoreceptor 2 is exposed to neutralization light to the developing position where the photoreceptor 2 faces the developing device 4. In particular, when the leading edge X of the non-charged portion reaches the developing position where the photoreceptor 2 faces the developing device 4, as illustrated in FIG. 3I, the developing bias is switched from negative to positive.

The reason that the developing bias is switched from negative to positive is to prevent toner particles stored in the developing device 4 from unnecessarily transferring to the photoreceptor 2. This is because if the developing device 4 is kept being negative, the developing device 4 is more negative than the non-charged portion of the photoreceptor 2 that has a lower negative potential than the charged portion. As a result, the toner particles being negatively charged receive repulsive force from the developing device 4 and are likely to transfer from the developing device 4 to the photoreceptor 2. By switching the developing bias from negative to positive to make the developing device 4 more positive than the non-charged portion, the toner particles are prevented from transferring to the photoreceptor 2.

Figure 3J:
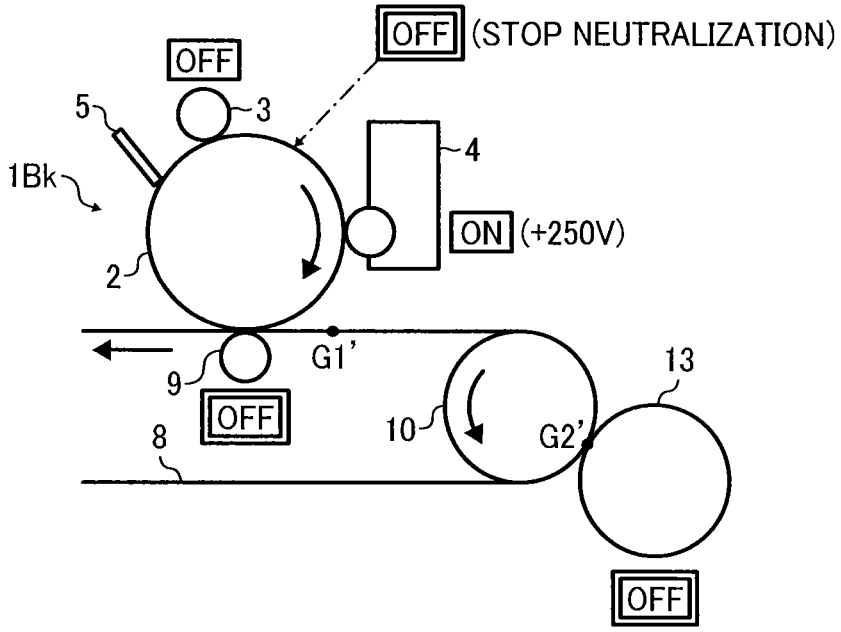

At a timing (j) shown in FIG. 2, the exposure of the photoreceptor 2 to neutralization light is terminated. Thus, the neutralization process is completed. The timing (j) comes after the elapse of a period of time T5 from the timing (h). The period of time T5 is required for the photoreceptor 2 to rotate one revolution. In particular, the neutralization process is completed when the photoreceptor 2 has rotated one revolution after the exposure of the photoreceptor 2 to neutralization light is started. At the same time, as illustrated in FIG. 3J, a trailing edge G2' of the toner image having been transferred onto the intermediate transfer belt 8 reaches the secondary transfer position and the application of the secondary transfer bias is terminated. At the same time, the application of the primary transfer bias and drive of the driving motor are terminated.

The timings (g) and (j) for starting and terminating application of the secondary transfer bias to the secondary transfer roller 13 are determined depending on the timings (e) and (f) for starting and terminating exposure of the photoreceptor 2 to printing light, respectively. Alternatively, the timings (g) and (j) for starting and terminating application of the secondary transfer bias to the secondary transfer roller 13 can be determined depending on respective timings at which the leading and trailing edges of a sheet of paper are detected by a paper detector provided near the registration rollers 20.

Figure 3K:
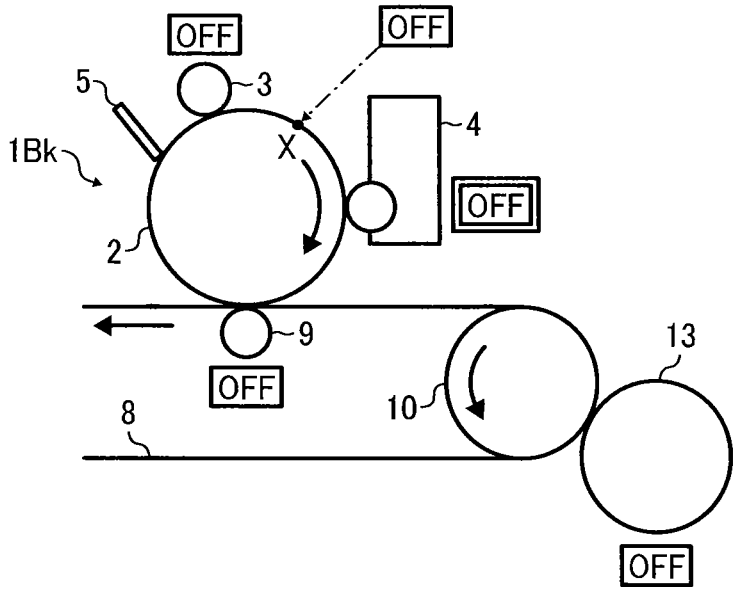

At a timing (k) that comes after the elapse of a period of time T7 from the timing (j), the driving motor stops driving. At the same time, the application of the developing bias to the developing device 4 is terminated. Thus, a series of operational sequences is completed, as illustrated in FIG. 3K.

In the present embodiment, as illustrated in FIG. 3H, after the toner image is transferred from the photoreceptor 2, the surface of the photoreceptor 2 is neutralized by being exposed to neutralization light emitted from the exposure device 6. The output of the primary transfer bias is then lowered before the leading edge X of the neutralized portion (i.e., non-charged portion) of the photoreceptor 2 reaches the primary transfer position. By lowering the output of the primary transfer bias, the non-charged portion is prevented from being effected by the charge of the primary transfer roller 9 when passing through the primary transfer position. Thus, it is not necessary to provide another neutralizer for neutralizing the surface of the photoreceptor 2 at a downstream side from the primary transfer position relative to the direction of rotation of the photoreceptor 2, preventing the image forming apparatus from getting larger in size and cost.

In the present embodiment, the output of the primary transfer bias is lowered in a gradual manner (e.g., first lowered from +1,000 V to +500 V and then to 0 V) rather than reduced to 0 V at once. Even by reducing it to 0 V at once, the non-charged portion can be prevented from being effected by the charge of the primary transfer roller 9 when passing through the primary transfer position. However, if the primary transfer bias is changed considerably when the toner image is subject to the secondary transfer in the secondary transfer position, the effective voltage in the secondary transfer position is changed. As a result, lateral lines and density changes may be undesirably generated in the resulting image due to the change of the primary transfer bias. To prevent the above-described problem, according to another embodiment, the timing for changing the primary transfer bias is shifted from the timing of the secondary transfer. However, in such an embodiment, the processing unit and intermediate transfer belt may be subject to drive for an extended period of time while shortening their lifespans. In the present embodiment, by lowering the primary transfer bias in a gradual manner, the generation of lateral lines and density changes in the resulting image, which may be caused due to the change of the primary transfer bias, is prevented. Also, unnecessary drives of the processing unit and intermediate transfer belt are prevented so as to extend their lifespans.

In some embodiments, the timing (j) for terminating the neutralization process is coincident with the timing at which the trailing edge of the sheet passes through the secondary transfer position. According to such embodiments, it is possible to simultaneously terminate the drives of the processing unit and intermediate transfer belt 8 without letting one of the processing unit and intermediate transfer belt 8 idle, when they are driven by a common driving motor.

Figure 4:
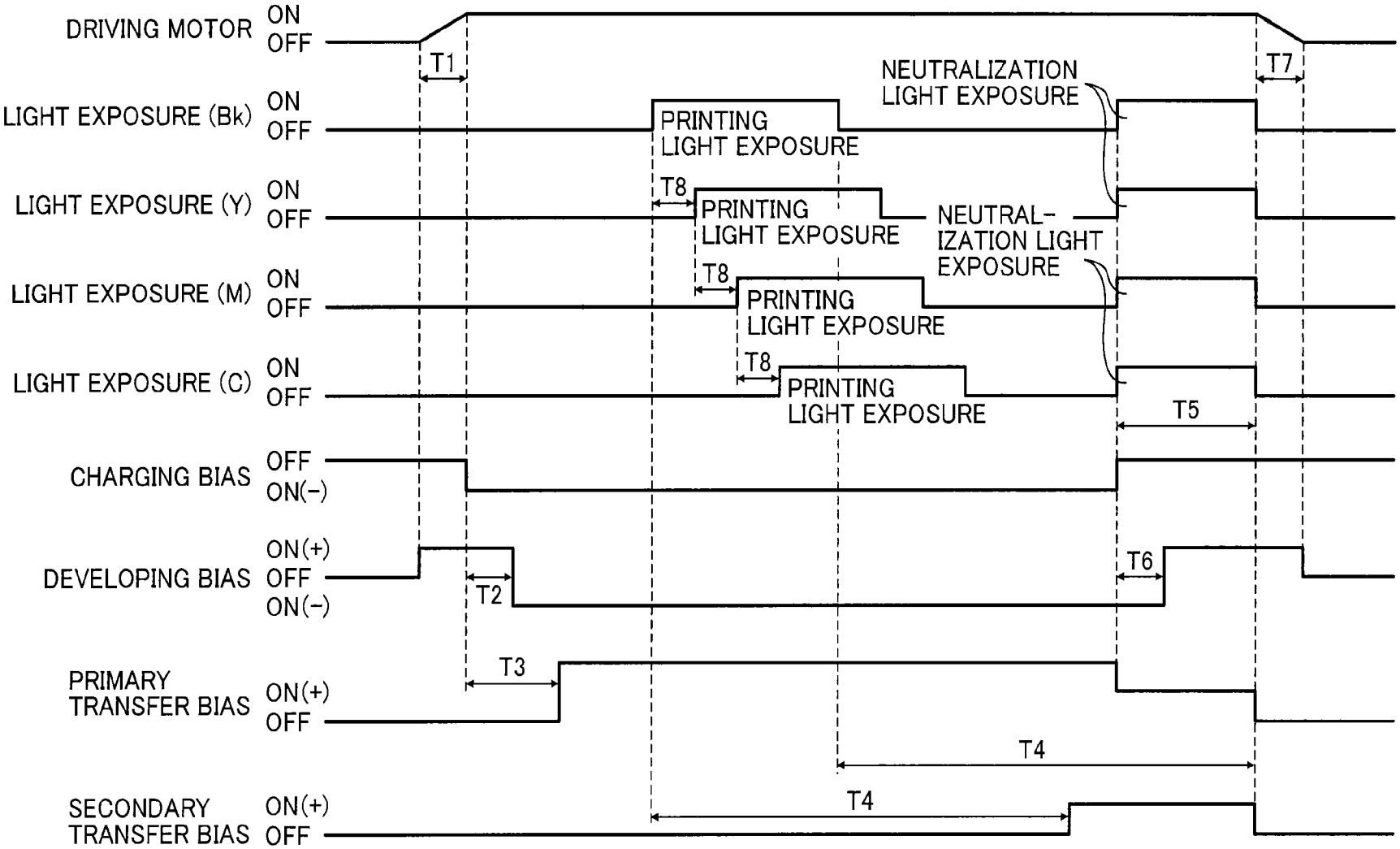
FIG. 4 is a timing chart showing operational sequences in forming a full-color image by the above image forming apparatus according to an embodiment.

FIG. 4 is a timing chart showing operational sequences in forming a full-color image by the above-described image forming apparatus according to an embodiment.

In FIG. 4, the operational sequences labeled IRRADIATION (Bk), IRRADIATION (Y), IRRADIATION (M), and IRRADIATION (C) show timings for exposing each photoreceptor 2 in each of the processing units 1Bk, 1Y, 1M, and 1C to printing light, respectively, so that an electrostatic latent image is formed thereon. For sequentially transferring each toner image formed on each photoreceptor 2 onto the intermediate transfer belt 8, each photoreceptor 2 is exposed to printing light after the elapse of a period of time T8 from a timing when the immediately upstream photoreceptor 2 is exposed to printing light.

The period of time T8 is required for a surface of the intermediate transfer belt 8 to travel between adjacent primary transfer positions in the processing units 1Bk, 1Y, 1M, and 1C arranged at equal intervals (e.g., 80 mm).

In each of the processing units 1Bk, 1Y, 1M, and 1C, the exposure of each photoreceptor 2 to neutralization light is started at the same time and is terminated at the same time. By simultaneously terminating the exposure of each photoreceptor 2 to neutralization light in each of the processing units 1Bk, 1Y, 1M, and 1C, one or more of the processing units are prevented from idling when they are driven by a common driving motor.

The rest of the operational sequences illustrated in FIG. 4 is substantially the same as that illustrated in FIG. 2 so the explanation therefor is omitted.

Figure 5:
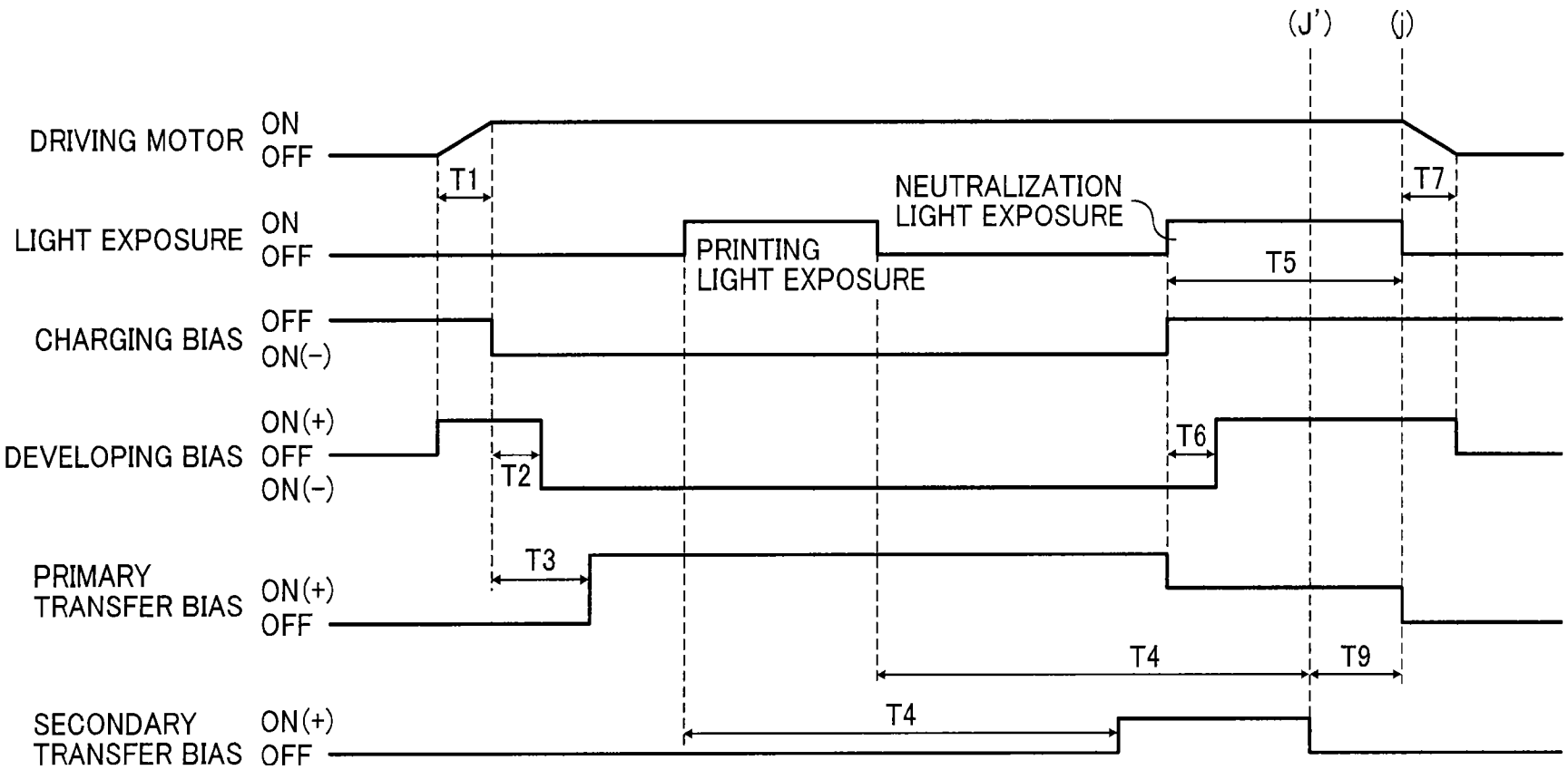
FIG. 5 is a timing chart showing operational sequences in forming a single-color image according to another embodiment.

FIG. 5 is a timing chart showing operational sequences in forming a single-color image according to another embodiment.

In an embodiment illustrated in FIG. 2, the timing (j) for terminating the drive of the driving motor is coincident with the timing for terminating the application of the secondary transfer bias. According to some embodiments, these timings are not necessarily coincident with each other. This is because, for example, there may be a case in which a sheet of paper cannot be timely fed to the secondary transfer nip due to the occurrence of a slippage between a feed roller and the sheet. In this case, if the application of the secondary transfer bias and the drive of the driving motor are terminated at the same time, the intermediate transfer belt 8 stops driving before the trailing edge of the sheet gets out of the secondary transfer nip. In view of the above-described case in which the sheet cannot be timely fed to the secondary transfer nip, in an embodiment illustrated in FIG. 5, the timing (j) for terminating the drive of the driving motor is delayed. More specifically, the timing (j) for terminating the drive of the driving motor comes after the elapse of a period of time T9 (e.g., 0.1 sec), equivalent to the delay caused in feeding the sheet, from a timing (j') for terminating the application of the secondary transfer bias. In this embodiment, the sheet can get out of the secondary transfer nip even when a delay is caused in feeding the sheet.

As another example, when the intermediate transfer belt 8 and the fixing device 21 are driven by a common driving motor, the timing for terminating the drive of the driving motor is delayed from the timing for terminating the application of the secondary transfer bias. In this case, the timing (j') for terminating the drive of the driving motor comes after the trailing edge of the sheet gets out of the fixing device 21.

The timing for lowering the output of the primary transfer bias can be made either earlier or later than the timing (h) shown in FIG. 2.

Figure 6:
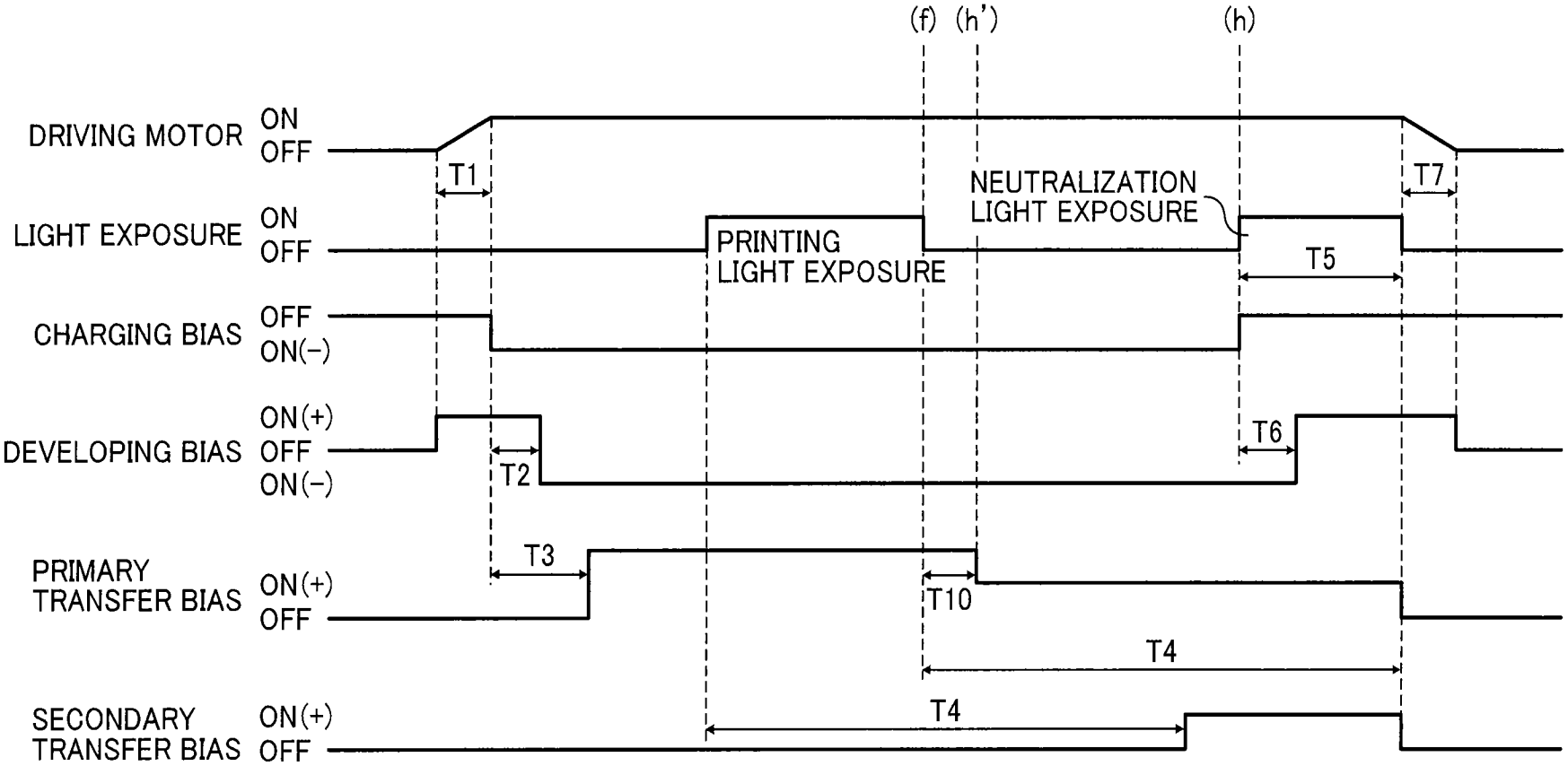
FIG. 6 is a timing chart showing operational sequences in forming a single-color image according to another embodiment.
Figure 7:
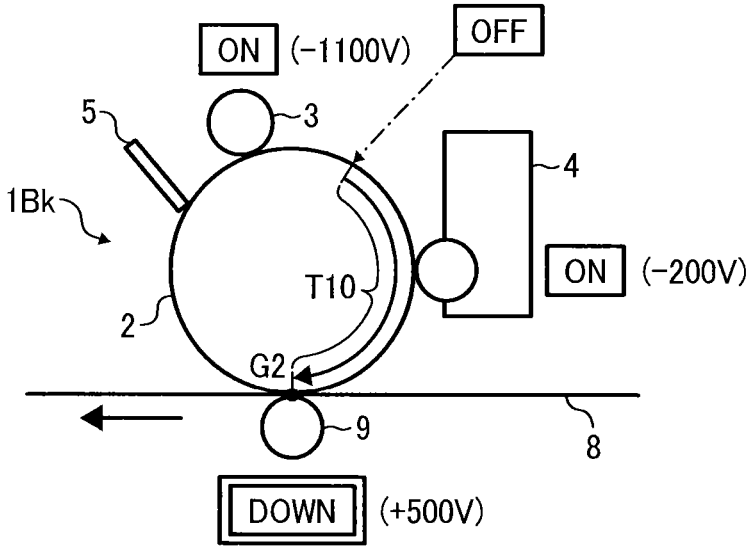
FIG. 7 is a situational view of the image forming apparatus according to FIG. 6.

In an embodiment illustrated in FIG. 6, the output of the primary transfer bias is lowered at a timing (h') before the exposure to neutralization light is started at a timing (h), unlike the embodiment illustrated in FIG. 2 in which the output of the primary transfer bias is lowered and the exposure to neutralization light is started at the same timing (h). In the embodiment illustrated in FIG. 6, the timing (h') for lowering the output of the primary transfer bias comes after the elapse of a period of time T10 from a timing (f) for terminating the exposure of the photoreceptor 2 to printing light. The period of time T10 is required for a surface of the photoreceptor 2 to travel from the position where the photoreceptor 2 is exposed to printing light to the primary transfer position. In particular, when the trailing edge G2 of the latent image reaches the primary transfer position, as illustrated in FIG. 7, the output of the primary transfer bias is lowered. There is no problem with lowering the output of the primary transfer bias after the trailing edge G2 of the latent image has passed through the primary transfer position because the primary transfer bias no longer needs to be strong enough to transfer toner images. Advantageously, the earlier the timing (h') for lowering the output of the primary transfer bias, the less the amount of consumption energy.

Figure 8:
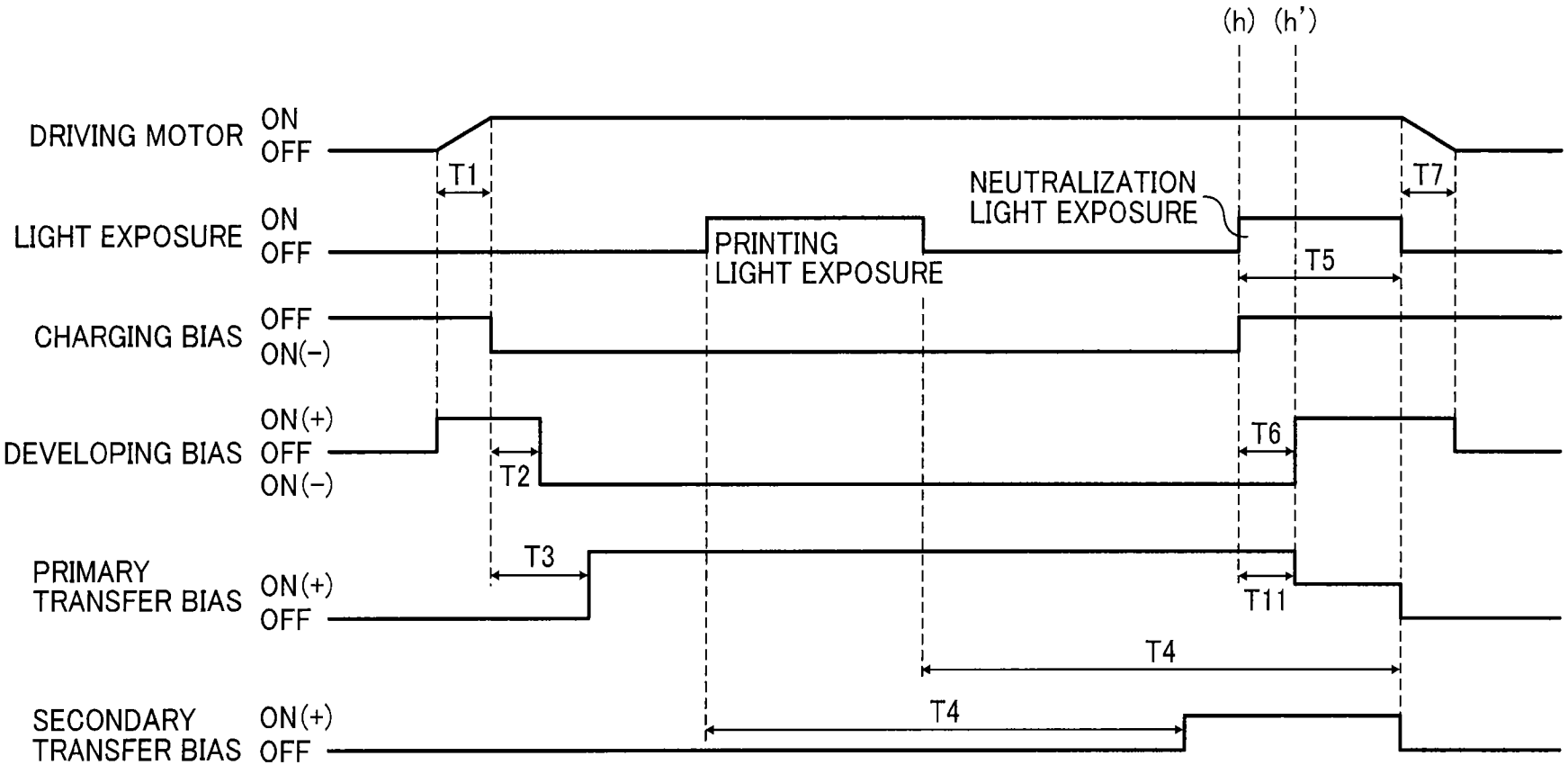
FIG. 8 is a timing chart showing operational sequences in forming a single-color image according to another embodiment.
Figure 9:
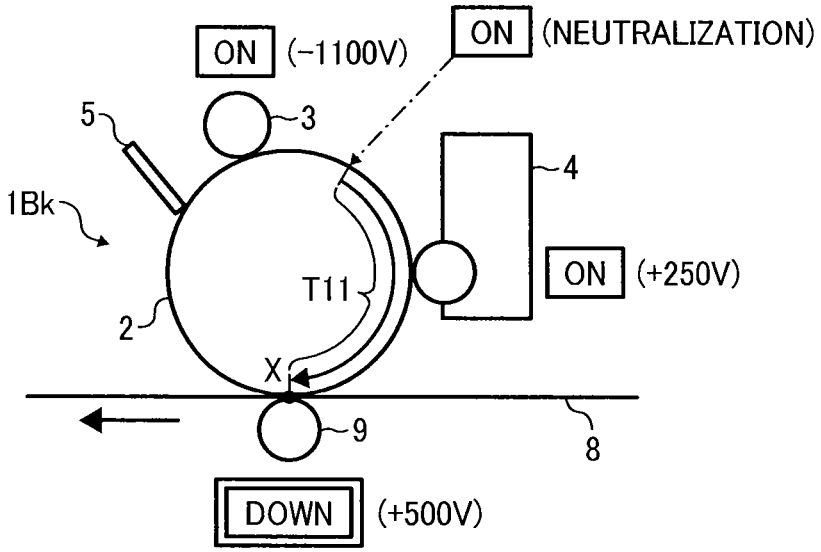
FIG. 9 is a situational view of the image forming apparatus according to FIG. 8.

By contrast, in an embodiment illustrated in FIG. 8, the output of the primary transfer bias is lowered at a timing (h') after the exposure to neutralization light is started at a timing (h), unlike the embodiment illustrated in FIG. 2 in which the output of the primary transfer bias is lowered and the exposure to neutralization light is started at the same timing (h). In the embodiment illustrated in FIG. 8, the timing (h') for lowering the output of the primary transfer bias comes after the elapse of a period of time T11 from the timing (h) for starting the exposure of the photoreceptor 2 to neutralization light. The period of time T11 is required for a surface of the photoreceptor 2 to travel from the position where the photoreceptor 2 is exposed to neutralization light to the primary transfer position. In particular, when the leading edge X of the non-charged portion reaches the primary transfer position, as illustrated in FIG. 9, the output of the primary transfer bias is lowered. There is no problem with setting the timing (h') to a relatively later stage of the operational sequence because the lowering of the output of the primary transfer bias has only to be performed before the leading edge X of the non-charged potion reaches the primary transfer position.

From the viewpoint of reduction of consumption energy, the timing for lowering the primary transfer bias is preferably as earlier as possible. On the other hand, in the embodiment illustrated in FIG. 4 that requires multiple steps of exposure to printing light at a certain time interval, it is not always preferable to make the timing for lowering the primary transfer bias as earlier as possible.

For example, assume a case in which the primary transfer bias in the first processing unit is lowered after the exposure of the first photoreceptor 2 to printing light is terminated but before image information for the second photoreceptor 2 is received, for making the timing for lowering the primary transfer bias as earlier as possible. Since the lowering of the primary transfer bias is involved in operational sequences relating to the neutralization of the photoreceptor 2, a drive terminating operation starts upon the lowering of the output of the primary transfer bias. Therefore, if image information for the second photoreceptor 2 is to be received after the primary transfer bias in the first processing unit is lowered, the drive terminating operation has to be stopped and a driving operation has to be restarted.

By contrast, in another case in which the timing for lowering the primary transfer bias is delayed and image information for the second photoreceptor 2 is received before the primary transfer bias in the first processing unit is lowered, it is possible that the exposure of the second photoreceptor 2 to printing light is started without restarting of any driving operation. By delaying the timing for lowering the primary transfer bias, which is involved in operational sequences relating to the neutralization of the photoreceptor 2, it is much easier to sequentially perform the multiple steps of exposure to printing light. Accordingly, it is preferable that the timing for lowering the primary transfer bias is made as earlier as possible so long as multiple steps of exposure to printing light can be sequentially performed.

The timing for lowering the output of the charging bias can be made either earlier or later than the timing (h) shown in FIG. 2.

Figure 10:
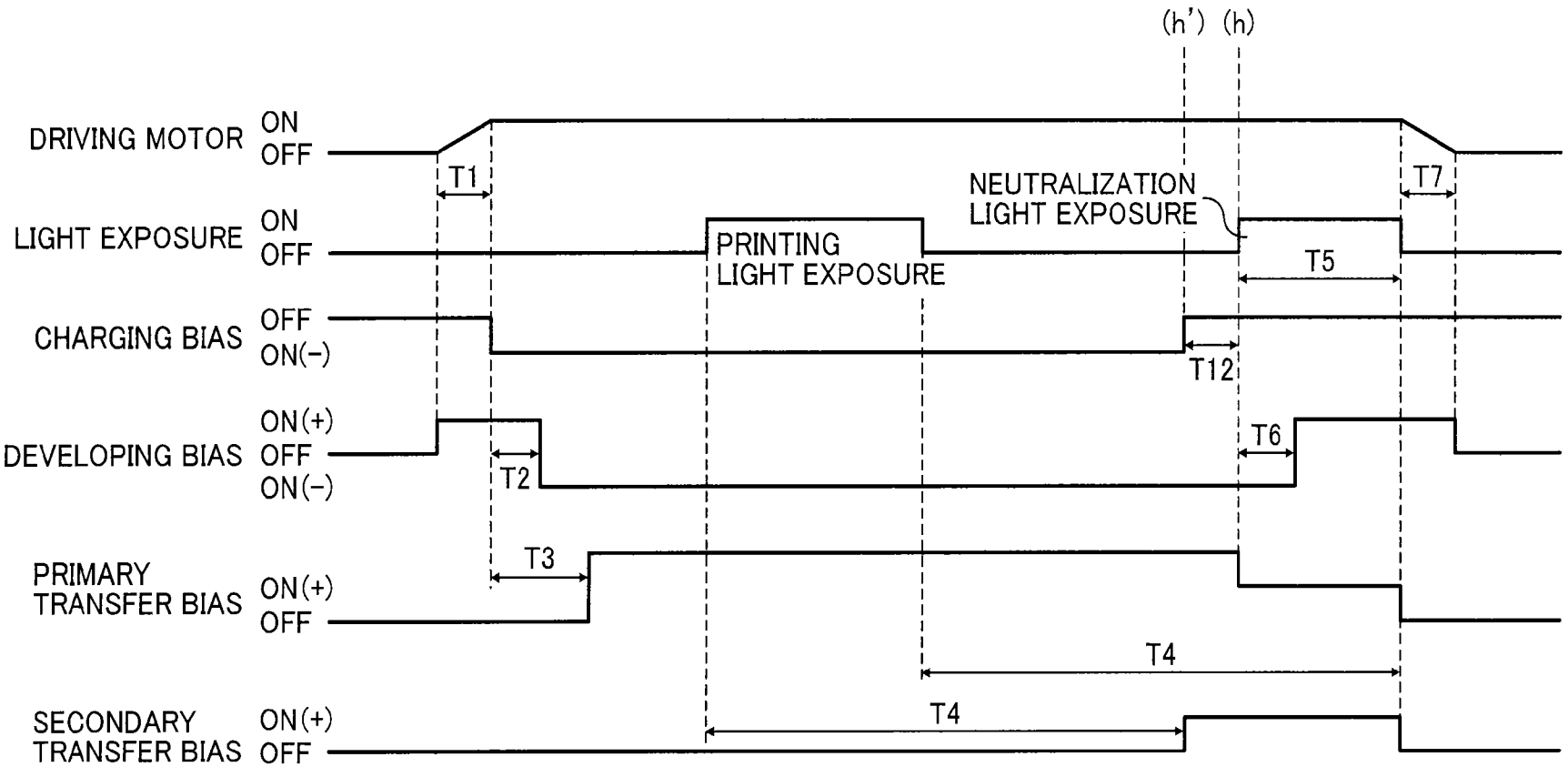
FIG. 10 is a timing chart showing operational sequences in forming a single-color image according to another embodiment.
Figure 11:
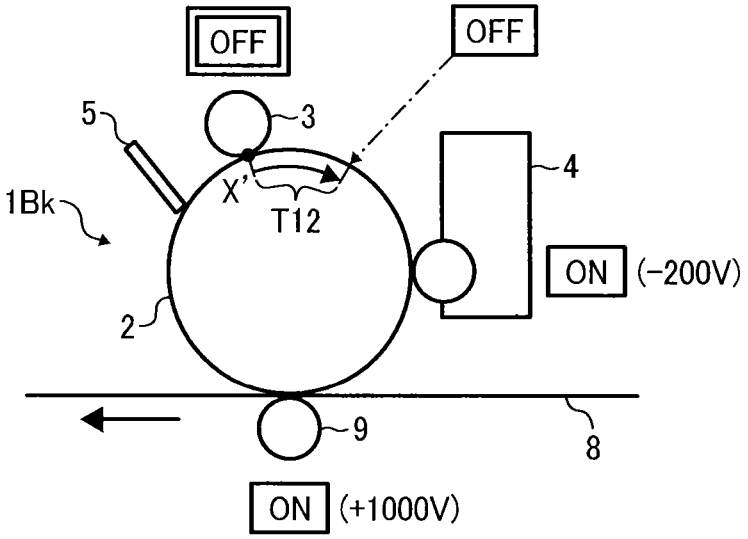
FIG. 11 is a situational view of the image forming apparatus according to FIG. 10.

In an embodiment illustrated in FIG. 10, the output of the charging bias is lowered at a timing (h') before the exposure to neutralization light is started at a timing (h), unlike the embodiment illustrated in FIG. 2 in which the output of the charging bias is lowered and the exposure to neutralization light is started at the same timing (h). In the embodiment illustrated in FIG. 10, the timing (h') comes a certain period of time T12 prior to the timing (h) for starting the exposure of the photoreceptor 2 to neutralization light. The period of time T12 is required for a surface of the photoreceptor 2 to travel from the charging position to the position where the photoreceptor 2 is exposed to neutralization light (hereinafter "exposure position"). In particular, when a leading edge X' of a portion to be neutralized passes through the charging position, as illustrated in FIG. 11, the application of the charging bias is terminated. Thus, the exposure to neutralization light is started when the leading edge X' of the non-charged portion reaches the exposure position, resulting in reduction of consumption energy for the charging bias.

Figure 12:
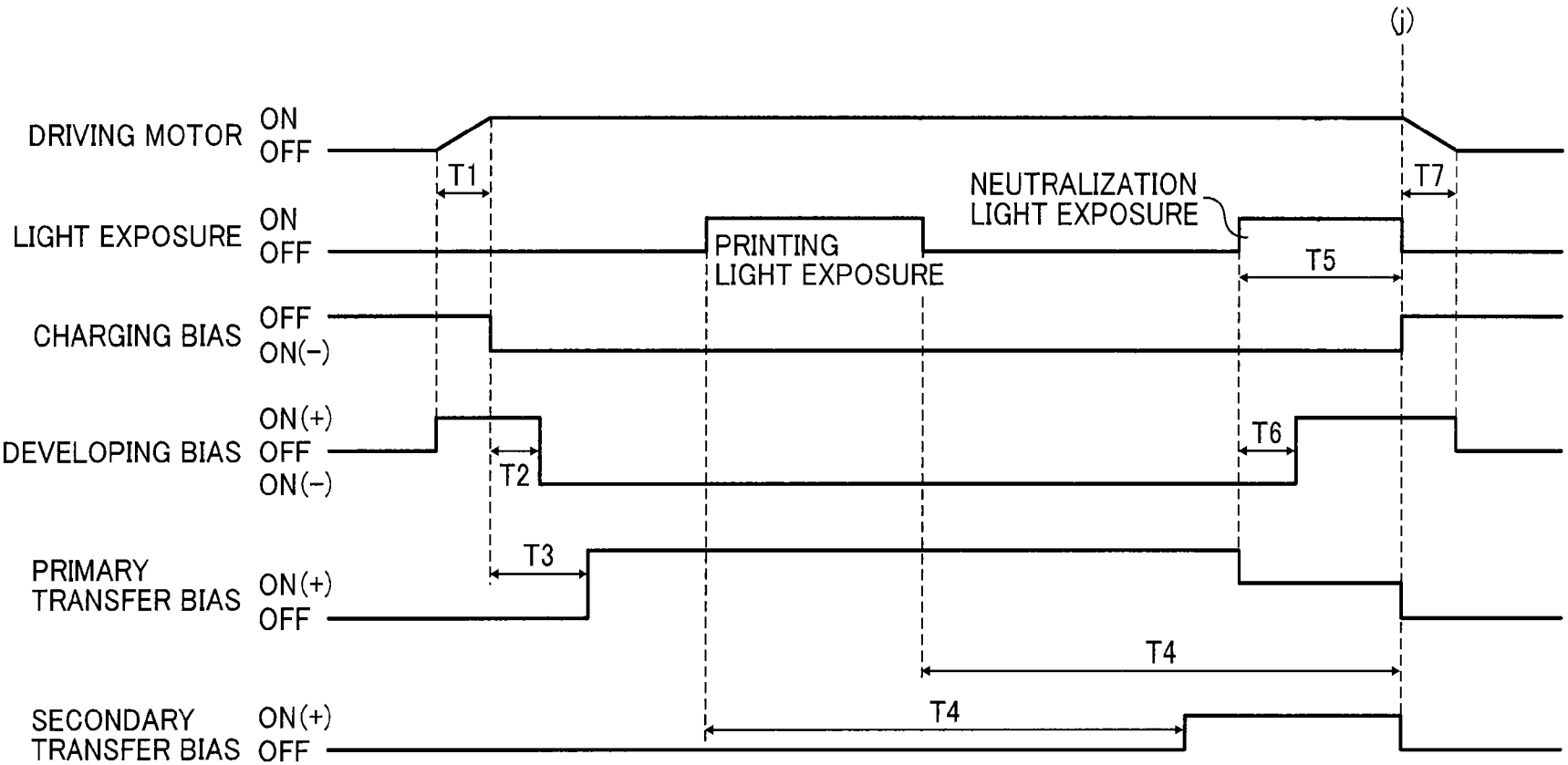
FIG. 12 is a timing chart showing operational sequences in forming a single-color image according to another embodiment.

By contrast, in an embodiment illustrated in FIG. 12, the timing for lowering the output of the charging bias is delayed. In the embodiment illustrated in FIG. 12, the timing for lowering the charging bias is coincident with a timing (j) for terminating the exposure of the photoreceptor 2 to neutralization light. In this embodiment, the photoreceptor 2 is subject to charging and then to neutralization immediately after the charging, which results in waste of energy. From the viewpoint of reduction of consumption energy, the timing for lowering the charging bias is preferably as earlier as possible. However, it is not always preferable to make the timing for lowering the charging bias as earlier as possible when multiple steps of exposure to printing light are required to be sequentially performed. Accordingly, it is preferable that the timing for lowering the charging bias is made as earlier as possible so long as multiple steps of exposure to printing light can be sequentially performed.

In each of the above-described embodiments, an indirect transfer method is employed in which a toner image on a photoreceptor is transferred onto a recording medium via an intermediate transfer belt. According to another embodiment, a direct transfer method is employed in which a toner image on a photoreceptor is directly transferred onto a recording medium. In accordance with some embodiments, any types of image forming apparatuses, such as printers, copiers, and facsimile machines, are applicable.

Figure 13:
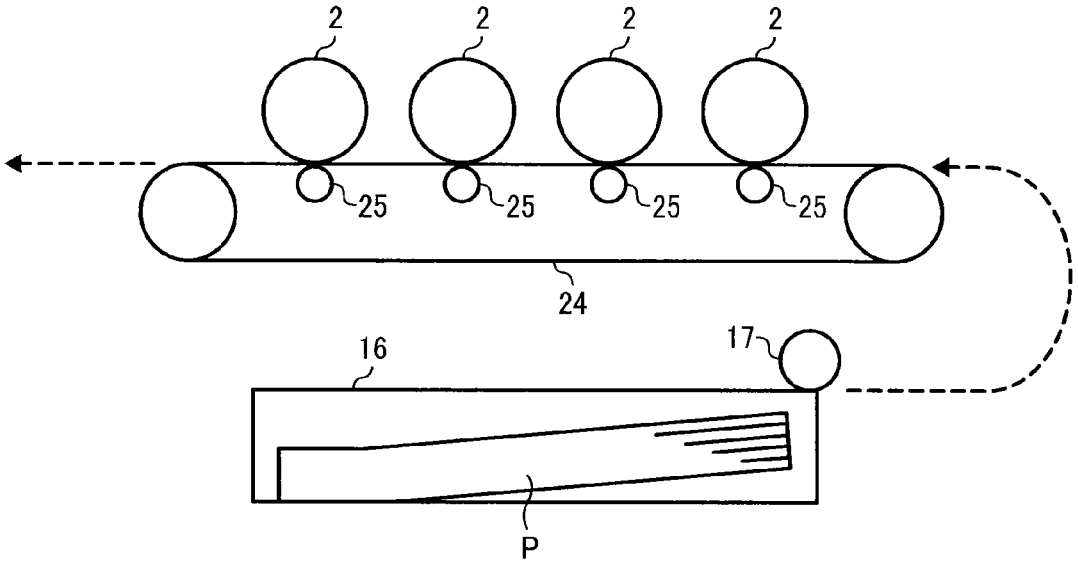
FIG. 13 is a schematic view of an image forming apparatus which employs a direct transfer method according to an embodiment.

FIG. 13 is a schematic view of an image forming apparatus which employs a direct transfer method according to an embodiment.

In this image forming apparatus employing a direct transfer method, a recording medium P stored in a paper feed tray 16 is fed onto a conveyance belt 24, in the form of an endless belt, by a paper feed roller 17. The recording medium P is conveyed as the conveyance belt 24 rotates so that toner images formed on respective photoreceptors 2 are sequentially transferred onto the recording medium P. At this time, transfer rollers 25, disposed facing the photoreceptors 2 with the conveyance belt 24 therebetween, are each supplied with a transfer bias and a transfer electric field is formed between each photoreceptor 2 and transfer roller 25. Thus, each toner image on each photoreceptor 2 is transferred onto the recording medium P on the conveyance belt 24 by the action of the transfer electric field.

When a surface of the photoreceptor 2 passes through the transfer position, the surface is effected by the charge of the transfer roller 25 and charged to have the opposite polarity to the toner. By lowering the output of the transfer bias before the non-charged portion of the photoreceptor 2 reaches the transfer position, the non-charged portion is prevented from being effected by the charge of the transfer roller 25 while passing through the transfer position.

In the above-described embodiments, the exposure device 6 functions as both a latent image forming device to form an electrostatic latent image on the photoreceptor 2 and a neutralizer to neutralize the surface of the photoreceptor 2, resulting in reduction of size and cost of the apparatus. According to another embodiment, a latent image forming device and a neutralizer are provided independently from each other. In the above-described embodiments, the processing units 1Bk, 1Y, 1M, and 1C and the intermediate transfer belt 8 are driven by a common driving motor, resulting in reduction of size and cost of the apparatus. According to another embodiment, the processing units 1Bk, 1Y, 1M, and 1C and intermediate transfer belt 8 are provided independently from one another.

In accordance with some embodiments, by lowering the strength of the transfer electric field when a non-charged portion (or neutralized portion) of the photoreceptor passes through the transfer position, the non-charged portion is prevented from being effected by the charge of the transfer electric field. Thus, there is no need to provide a neutralizer to neutralize the non-charged portion having passed through the transfer position, resulting in a simple, compact, and low-cost apparatus.

In accordance with some embodiments, the strength of the transfer electric field is lowered by lowering the output of the primary transfer bias in a gradual manner. As a result, generation of lateral lines and density changes in the resulting image, which may be caused due to the change of the primary transfer bias, is prevented and high-quality image is provided. By lowering the primary transfer bias in a gradual manner, a timing for changing the primary transfer bias needs not to be shifted from a timing for the secondary transfer bias. As a result, unnecessary drives of the processing unit and intermediate transfer belt are prevented, resulting in their extended lifespans.

Additional modifications and variations in accordance with further embodiments of the present invention are possible in light of the above teachings. It is therefore to be understood that within the scope of the appended claims the invention may be practiced other than as specifically described herein.

What is claimed is:

1. An image forming apparatus, comprising:

a latent image bearing member to bear a latent image on its surface;

a charger to charge a surface of the latent image bearing member;

a latent image forming device to form a latent image on the charged surface of the latent image bearing member;

a developing device to supply a toner to the latent image to develop the latent image into a toner image;

a transfer device to transfer the toner image formed on the latent image bearing member onto an intermediate transfer member or a recording medium by action of a transfer elected field in a transfer position where the latent image bearing member faces the transfer device; and a neutralizer to neutralize a surface of the latent image bearing member to form the non-charged portion, the neutralizer being disposed between a charging position where the latent image bearing member faces the charger and the transfer position, wherein when a non-charged portion of the latent image bearing member that has not been charged to a predetermined potential by the charger passes through the transfer position, a strength of the transfer electric field is lower than the strength of the transfer field when transferring the toner image, wherein the transfer device includes:

a primary transfer device to transfer the toner image on the latent image bearing member onto the intermediate transfer member; and a secondary transfer device to transfer the toner image on the intermediate transfer member onto the recording medium, wherein the latent image bearing member and the intermediate transfer member are driven by a common driving source, and wherein the neutralizer stops neutralizing the surface of the latent image bearing member when a trailing edge of the recording medium passes through a secondary transfer position where the intermediate transfer member faces the secondary transfer device.

2. The image forming apparatus according to claim 1, wherein when the non-charged portion passes through the transfer position, the strength of the transfer electric field is lowered in a gradual manner.

3. The image forming apparatus according to claim 1, wherein the strength of the transfer electric field is lowered after a trailing edge of the toner image on the latent image bearing member passes through the transfer position but before a leading edge of the non-charged portion reaches the transfer position.

4. The image forming apparatus according to claim 1, wherein a potential of the developing device is controlled to have the opposite polarity to the toner relative to a potential of the non-charged portion, before a leading edge of the non-charged portion reaches a developing position where the latent image bearing member faces the developing device.

5. The image forming apparatus according to claim 1, wherein when a surface of the latent image bearing member to be neutralized by the neutralizer passes through the charging position, a charging voltage of the charger is lowered than that in forming the latent image.

6. The image forming apparatus according to claim 1, wherein the number of the latent image bearing member is two or more, and each of the latent image bearing member is neutralized by the neutralizer after a latent image is formed on the each of the latent image bearing members.

7. The image forming apparatus according to claim 1, wherein the latent image forming device also serves as the neutralizer.

8. The image forming apparatus according to claim 1, wherein the strength of the transfer electric field is lowered by lowering a transfer voltage supplied to the transfer device.

9. An image forming method, comprising:

charging a surface of a latent image bearing member;

forming a latent image on the charged surface of the latent image bearing member;

supplying a toner to the latent image to develop the latent image into a toner image by a developing device;

transferring the toner image formed on the latent image bearing member onto an intermediate transfer member or a recording medium by action of a transfer elected field in a transfer position where the toner image is transferred from the latent image bearing member;

lowering a strength of the transfer electric field when a non-charged portion of the latent image bearing member that has not been charged to a predetermined potential passes through the transfer position; and neutralizing a surface of the latent image bearing member to form the non-charged portion at between a charging position where the latent image bearing member is charged and the transfer position, wherein the transferring includes:

primarily transferring the toner image on the latent image bearing member onto the intermediate transfer member; and secondarily transferring the toner image on the intermediate transfer member onto the recording medium at a secondary transfer position, and wherein the method further comprises:

driving the latent image bearing member and the intermediate transfer member by a common driving source; and stopping neutralizing the surface of the latent image bearing member when a trailing edge of the recording medium passes through the secondary transfer position.

10. The image forming method according to claim 9, wherein the lowering includes lowering the transfer electric field in a gradual manner.

11. The image forming method according to claim 9, wherein the lowering is performed after a trailing edge of the toner image on the latent image bearing member passes through the transfer position but before a leading edge of the non-charged portion reaches the transfer position.

12. The image forming method according to claim 9, further comprising:

controlling a potential of the developing device to have the opposite polarity to the toner relative to a potential of the non-charged portion, before a leading edge of the non-charged portion reaches a developing position where the latent image is formed into the toner image.

13. The image forming method according to claim 9, further comprising:

lowering a charging voltage when a surface of the latent image bearing member to be neutralized passes through the charging position.

* * * * *